US005713968A

United States Patent [19]

Fruitman et al.

[11] Patent Number: 5,713,968

[45] Date of Patent: Feb. 3, 1998

[54] ABRASIVE FOAM GRINDING COMPOSITION

[75] Inventors: Clinton O. Fruitman, Chandler; Andrew Gluck, Tucson; John L. Lombardi, Tucson; Kevin L. Stuffle, Tucson, all of Ariz.

[73] Assignee: Speedfam Corporation, Chandler, Ariz.

[21] Appl. No.: 655,297

[22] Filed: May 16, 1996

[51] Int. Cl.[6] ..... B24D 3/34; B24D 11/02

[52] U.S. Cl. ..... 51/296; 51/293

[58] Field of Search ..... 51/293, 296

[56] References Cited

U.S. PATENT DOCUMENTS

| | | | |
|---|---|---|---|
| 2,734,812 | 2/1956 | Robie | 51/296 |
| 2,806,772 | 9/1957 | Robie | 51/296 |
| 2,986,455 | 5/1961 | Sandmeyer | 51/296 |
| 3,925,034 | 12/1975 | Anna et al. | 51/296 |
| 5,472,461 | 12/1995 | Li | 51/296 |

*Primary Examiner*—Deborah Jones

*Attorney, Agent, or Firm*—Snell & Wilmer; Michael K. Kelly

[57] ABSTRACT

The present invention relates generally to abrasive stone pads for use in processing workpiece surfaces. The abrasive stones generally are produced by combining a phenolic resin mixture with a diluent and then injecting microballoon structures into the resin/diluent mixture to create a porous solution. The diluent is initially ball milled with an abrasive in a tumbler to eliminate the agglomerates and is then added to a resin monomer. A suitable catalyst is added to the mixture to create a chemical reaction, further increasing the porocity of the substance. The mixture is poured into molds and with through a filter or frit plate to remove excess resin and diluent. Finally, the mixture is cured, creating abrasive stones having a uniform surface and bulk structure with a uniform hardness, suitable for workpiece grinding.

36 Claims, 4 Drawing Sheets

ABRASIVE FOAM GRINDING COMPOSITION

TECHNICAL FIELD

The present invention relates, generally, to abrasive foam grinding structures, and more particularly to methods for manufacturing a resin-based composite structure including microballoons for controlling friability, hardness, and cell density.

Abrasive foam materials for grinding, honing, and buffing the surfaces of workpieces are generally well known. For certain workpieces, e.g. computer hard drive substrates (hard disks), the desired surface finishes are becoming increasingly difficult to obtain by conventional techniques using known soft grinding "stones."

Presently known honing stones may be of an open-cell structure or a closed-cell structure. Open-cell stones are generally made from a combination of polyvinyl alcohol resins (PVA), starch, and a silicon carbide filler functioning as the abrasive material. Appropriate catalysts and co-polymers, for example, sulfuric acid and formaldehyde, are added to the PVA, starch, and silicon carbide mixture to convert the mixture to a rubber-like mass with the starch particles randomly distributed and trained therein.

The rubber-like mass is then flushed in a hot water shower to dissolve and flush out the starch from the composite. Upon flushing the starch from the mass, a random distribution of holes is formed having diameters in the range of 50–150 microns. The spongy mass may then be impregnated with a stiffening agent, e.g. melamine. The stiffening agent penetrates through the random distribution of holes coating the complex surfaces within the spongy mass. The excess stiffening agent within the holes may then be removed, for example, through centrifugal extraction or a subsequent rinsing process. The resulting stiffened sponging mass may then be dried and used to prepare the surface of workpieces (e.g. computer hard disks).

An alternative stiffening technique used in open-cell structures involves adding various rigid co-polymers to the PVA before curing to enhance the stiffness of the finished spongy mass.

Closed-cell structures are typically produced by mixing a "Part A" and "Part B" urethane resin together. With this process, one of the two parts is used to disperse an abrasive, such as silicon carbide. While Part A and Part B are stored separately prior to mixing, upon mixing together, the composite resin mixture is quickly introduced into a mold, whereupon a spontaneous exo-thermic cross-linking reaction occurs. The exo-thermic reaction between the two resins generates a substantial amount of heat. The heat expands blowing agents present within one or both of the resin components, forming foam or high density bubbles within the compound. The bubbles become entwined within the cross-link matrix resulting in a porous, closed-cell structure suitable for grinding, honing, and buffing.

When applied to a workpiece, an open-cell stone intentionally flakes, liberating particulates at the stone/workpiece interface. To remove these particulates, as well as to the remove particulates liberated from the workpiece and the heat generated at the interface, the workpieces are typically flushed with water or a water-based solution during the honing operation. Because of the open-cell structure, some of the particulates may have a tendency to penetrate into the stone, resulting in "loading" of debris within the stone. This loading can exasperate problems associated with the finish of the workpiece and the local stiffness deviations across the stone surface. In addition, incomplete mixing of Part A and Part B also results in nonhomogeneous or insufficiently homogenous regions, creating a nonuniform honing surface on the stone. A nonuniform mechanical surface may result in uneven material removal from the workpiece, and can also result in scratches and other blemishes being imparted to the workpiece. Attempts to increase the mixing rate of Part A and Part B have been unsatisfactory, inasmuch as the rate of reaction is often faster than even the most sophisticated mixing techniques.

Closed-cell urethane stones are also unsatisfactory in several regards. For example, the urethane stones comprise an inherently tough composite structure. Consequently, "flaps are" created as bubble surfaces are breached can scratch a workpiece if the flaps are not liberated from the stone and rinsed away. Moreover, both the PVA-based stones and the urethane-based stones require the use of highly toxic materials. This is particularly true of many isocyanide urethane resins.

Yet another known stone formation technique involves the use of phenolic resins combined with a foaming agent and a catalyst. The catalyst causes the foam "to explode," creating bubbles in the resin. The exo-thermic nature of the reaction cures the resin, trapping the bubbles within the mass.

Presently, known stone substances and techniques for manufacturing them are unsatisfactory in several regards. One of the principle drawbacks to known stone pad materials relates to the non-uniform mechanical structure of the honing surface. Non-uniform mechanical structures result in non-uniform removal of material from the workpiece, creating unsatisfactory workpiece surface finishes. In addition, imperfect dispersion of abrasives in resinous stones tend to yield agglomerates or nodules which project from the mean surface of the honing pad. Agglomerates can also cause scratching and surface imperfections in the workpiece. Moreover, the toxic nature of many of the components of known stones renders their manufacture, use, and disposal environmentally compromising and expensive to handle.

Finally, the cost of manufacturing presently known stones is getting increasingly high, exacerbating the problem of limited stone life.

A new honing stone composition and method for making and using a new stone composition is therefore needed which overcomes the limitations of the prior art.

SUMMARY OF THE INVENTION

The present invention provides an abrasive foam grinding, honing, and buffing material which overcomes many of the shortcomings of the prior art. In accordance with a particularly preferred embodiment of the present invention, a brittle, low modular weight phenolic resin mixture is combined with microballoons to produce a foam structure with highly desirable physical properties. In accordance with the further aspect of the present invention, an exemplary method of manufacturing a phenolic resin composite permits various physical and structural parameters of the stone to be tuned during manufacture.

In accordance with a further aspect of the present invention, highly consistent material removal rates may be obtained from stone to stone and from run to run for a particular stone.

In accordance with another aspect of the present invention, the stiffness and hence, the useful life of stones is enhanced.

In accordance with another aspect of the present invention, more uniform mechanical properties may be obtained across the surface and throughout the bulk of a stone.

In accordance with a further aspect of the present invention, a novel mixing chamber and mixing technique is employed to enhance the dispersion of the abrasive during the manufacturing process, thereby reducing the risk of agglomerate formation within the finished structure.

In accordance with a further aspect of the present invention, enhanced hardness may be obtained.

In accordance with another aspect of the present invention, maximum consumption of toxic materials is achieved, resulting in minimal environmental impact and minimal liberation of toxicity.

BRIEF DESCRIPTION OF THE DRAWING FIGURES

The present invention will hereinafter be described in conjunction with the appended drawing figures, wherein like numerals denote like elements, and:

DETAILED DESCRIPTION OF PREFERRED EXEMPLARY EMBODIMENTS

The subject invention relates to abrasive stone pads for use in processing workpiece surfaces. Although the workpiece to be processed may comprise virtually any device requiring a controlled finish, the present invention is conveniently described with reference to computer hard disks which require controlled surface finishes. It will be understood, however, that the invention is not limited to any particular type of workpiece or any particular type of surface finish.

Figure 1:
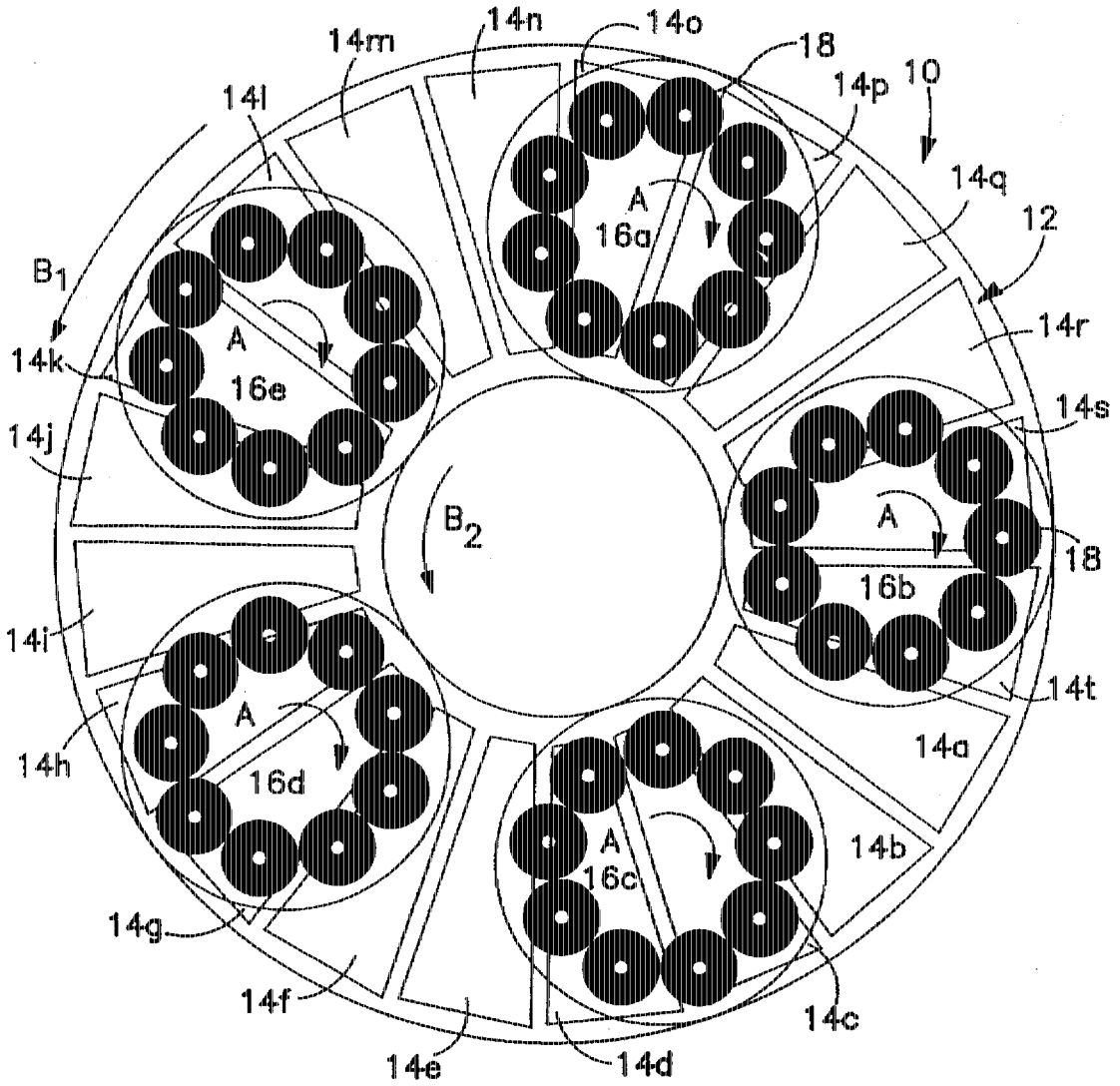
FIG. 1 is a plan schematic view of an exemplary platen supporting an abrasive stone table. A plurality of carriers, each carrying a plurality of workpieces to be honed are obtainably mounted to the platen to thereby place the workpieces in frictional contact with the abrasive stone surfaces.

Referring now to FIG. 1, a work table can suitably comprise an annular shaped platen wheel which supports a plurality of generally pie-shaped abrasive stone segments 14A–14N. A plurality of carriers 16A–16E each carry a plurality of workpieces 18, for example a computer hard disk substrate. In the embodiment shown in FIG. 1, a total of five carriers 16 each carry nine workpieces 18, for a total of forty-five workpieces. In accordance with a preferred embodiment of the invention, an oppositely disposed platen carrying a plurality of stone segments is disposed opposite platen 12 such that carrier 16 is sandwiched between opposing stony surfaces. Each carrier 16 is suitably configured to rotate about its axis in the direction indicated by arrow A; in addition, lower platen 12 is suitably configured to rotate about its axis in the direction indicated by arrow B and the upper platen is configured to rotate in a direction opposite of the lower platen. As a result, both surfaces of each workpiece 18 may be processed simultaneously, with a desirably uniform and even removal rate from each side simultaneously.

It should be noted, however, that any particular surface grinding or honing machine can be used with the grind stone of the preferred exemplary embodiment of the present invention. For example, a grinding machine may be configured to only grind and buff one side of the unfinished parts at a time, or the platen may comprise one large grinding stone instead of a plurality of segments of grinding stones as discussed below.

To optimize the surface characteristics of each workpiece 18, it is desirable that the mechanical surface of each stone segment 14 be uniform across the entire surface of each segment 14. Furthermore, it is desirable to maintain uniform mechanical characteristics across the surface of each segment 14 even as the stone surface is worn away, for example by passing a diamond dressing plate over the surface of the moving stone plates as is known in the art.

In accordance with a preferred embodiment of the present invention, typical removal rates on the order of 1–1.5 micro-inches every 3.5 minutes are desirably obtained for the various workpieces 18 upon which the stone surfaces operate. This is typically done under pressures on the order of about 1 to 2 pounds per square inch (PSI).

Although the shape of each stone segment 14 in FIG. 1 is generally pie-shaped, it is understood that virtually any stone shape may be utilized in the context of the present invention. In accordance with the preferred embodiment, a prepared resin mixture may be urged into a mold cavity, wherein the resinous mixture cures within the mold cavity. Upon curing, the mold cavity is open, revealing an abrasive stone of any desired shape corresponding to the shape of the mold.

The manner in which abrasive stones are manufactured in accordance with the present invention will now be described.

In accordance with the particularly preferred embodiment of the present invention, a brittle, low modular weight phenolic resin is suitably employed. A suitable phenolic resin solution may comprise a 70–90% by weight resin monomer in water, for example, product number ARJ11761 available from the Schenectady Chemical Company of Schenectady, N.Y. As discussed in greater detail below, microballoons are added to the phenolic resin to create a desirable cellular structure. In accordance with one aspect of the present invention, it is believed that the combination of the phenolic resin mixture with a suitable diluent will permit a greater number (higher density) of micro-balloons to be added to the resin mixture. In this regard, Applicants have determined that a suitable diluent may be formulated by combining 40–50% by weight deionized water and 50–60% by weight ethanol, and preferably 43% by weight water and 57% by weight ethanol. In a further embodiment of the present invention, the diluent may comprise a mixture of water, ethanol and furfuryl alcohol. In this further embodiment, the diluent may be formulated by combining 30–60% by weight water, 15–45% by weight ethanol and 15–45% by weight furfuryl alcohol. As is also discussed in greater detail, the amount of furfuryl present in the diluent may be manipulated to control the hardness of the finished stone structure.

Upon preparing a suitable diluent, 40–55% (preferably 47.2%) by weight of the diluent may be mixed with 45–60% (preferably 52%) by weight of silicon carbide and a small amount (e.g., a few drops) of a suitable dispersing agent, for example, AMP Regular manufactured by Angus Chemical Co. of Buffalo Grove, Ill., or Hypermer PS2 manufactured by ICI Surfactants of Wilmington, Del.

The diluent, silicon carbide, and dispersant mixture is suitably ball milled in a tumbler with small, hard beads, for example, on the order of 15 minutes or until all agglomerates are satisfactorily crushed. The resulting ball milled meal mixture is referred to herein as the dispersed silicon carbide.

The dispersed silicon carbide is then suitably transferred, for example through an appropriate filtering screen to remove agglomerate structures, milling beads, and the like, into an appropriate vessel, whereupon this may be added to a resinous compound, including approximately 20–35% by weight and preferably about 27.5% by weight phenolic resin monomer in the mixing vessel.

In this regard, although a preferred embodiment of the present invention employs a phenolic resin, it will be understood that virtually any material having similar properties may be employed, such as polymethylmethacrylates, epoxies and the like. In addition, suitable copolymers, hardening agents and defoamers may be added to the phenolic resin, as desired. A vacuum is then drawn in the vessel chamber to prevent the introduction of air into the mixing chamber during mixing, which helps control foam uniformity. It should also be noted that the dispersed silicon carbide and phenol resin mixture should be mixed at a fairly high shear rate. For this purpose a suitable commercial vacuum, chilled mixer, for example one available from the Meyers Engineering Company of Los Angeles, Calif. may be used. A vacuum is suitably drawn in the mixing chamber on the order of 20–30 inches of mercury and most preferably in the range of 25–27 inches of mercury. In this regard, because rapid stirring typically generates heat, it may also be desirable to maintain a fairly cool environment within the mixing chamber, for example on the order of 40°–60° F., to minimize the cross-linking and other reactions associated with the resin.

Under vacuum, approximately 55–75% and preferably 63.5% by weight dispersed silicon carbide, and approximately 20–35% and preferably about 27.5% by weight of the resin mixture are mixed with approximately 1.0–5.0% and preferably about 2.02% by weight of microballoons. The mixture may further include about 7% by weight defoam, for example, from Ultra Additives of Patterson, N.J. In accordance with the preferred embodiment, suitable microballoons are on the order of about 20–200 microns, and preferably on the order of about 80–150 microns in size. Suitable microballoons may be made from polyvinylacrylonitrile, for example, the microballoons manufactured by Akzo Nobel's Expancel Corporation of Sweden under the name DE80 Expancel Balloons. However, one skilled in the art should appreciate that any type of microballoon may be used in accordance with the preferred embodiment, for example, microballoons made of vinyl or acrylonitrile may be used.

In a preferred embodiment, the microballoons are added to the dispersed silicon carbide/resin mixture while these two components are being mixed together in the mixing chamber, preferably under vacuum to prevent the introduction of air. Moreover, the addition of the microballoons may also be followed by the addition of a suitable catalyst. For example, in accordance with the preferred embodiment of the present invention, about 5.0–9.0% and preferably about 7.0% by weight of phenolsulfonic acid having 65% by weight aqueous solution may be added to the mixture.

As briefly discussed earlier, a high cell density structure is desired, suggesting that a relatively high density of microballoons should be added to the mixture. However, there are physical and practical limits to which balloons may be added to the mixture while maintaining a flowable mixture. In this regard, the Applicants have determined that the diluent facilitates a fluid environment, thereby permitting the addition of a large number of microballoons. In addition, the diluent appears to impede the curing reaction to some extent.

Figure 2:
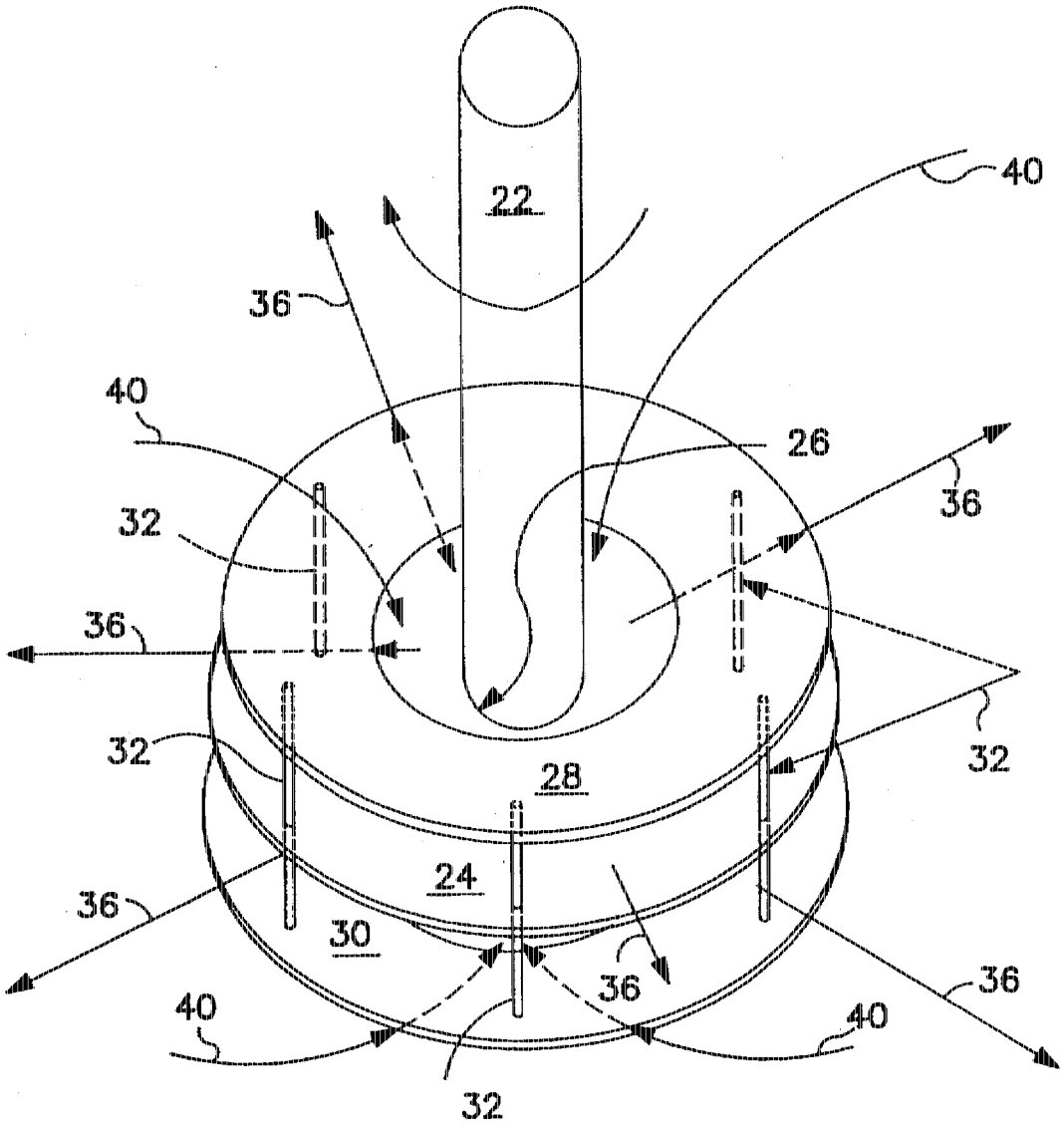
FIG. 2 is a prospective view of an exemplary spin blade configuration in accordance with the present invention.

Referring now to FIG. 2, the manner in which mixing is implemented within the chilled chamber in accordance with a preferred embodiment will now be described.

It is generally known that the increased dispersion of the silicon carbide within a resin reduces agglomerate nodules. However, presently known techniques for enhancing dispersion are not satisfactory because many typical rotor stator high sheer mixer blades can destroy microballoons.

Figure 3:
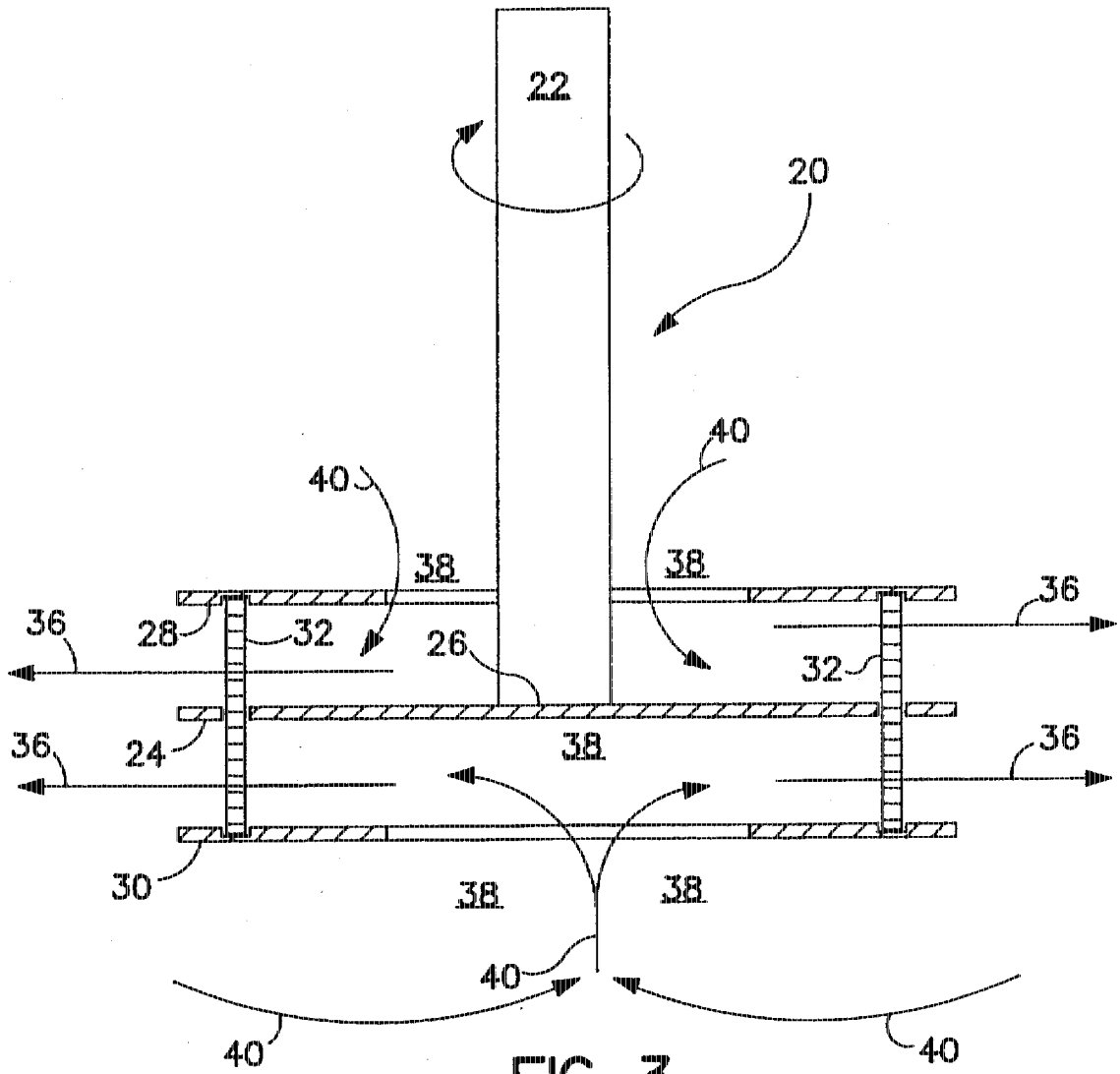
FIG. 3 is a cross-section side view of the blade structure of FIG. 2.

In accordance with a further aspect of the present invention, a Tesla style turban configuration is employed to enhance dispersion of the microballoons and silicon carbide within the mixing chamber. More particularly, and as shown in FIGS. 2 and 3, an exemplary mixing system 20 suitably comprises a rotating shaft 22 having a center blade 24 attached to the shaft, for example, via a well bead 26. An upper blade 28 and a lower blade 30 are also suitably coupled to center blade 24, for example by suitable stand off bolts or studs 32. At high rotation rates, for example on the order of 2,500 to 4,000 RPM, the viscous mixture within mixing vessel 34 in contact with middle blade 24 is urged radially outward away from shaft 22 as a result of the high centrifugal force created by the rotation of shaft assembly 20. The accelerated flow of mixture induced by the centrifugal forces associated with blade 24 essentially cause "needles" of the mixture to shoot radially away from shaft 22 at high rates of speed, for example along the direction indicated by arrows 36. These high velocity "needles" create high shear stresses in the volume of mixture surrounding the blades, effecting dispersion. At the same time, a corresponding vacuum is created in the region of blade 24 proximate shaft 22. This low pressure region 38 (FIG. 3) induces flow of mixture from the outer regions of blade 24 back toward shaft 22 along the direction of arrows 40.

In accordance with the illustrated embodiment, the spacing between the parallel blades 24, 28, and 30 is suitably on the order of 1/4-1 inch, with the outer diameter of the blades suitably on the order of 3–4 inches. With an approximately 6–7 gallons charge within the chamber, the dispersed silicon carbide and resin mixture is mixed together within the chamber for in the range of 5–20 minutes, and most preferably around 10 minutes. When sufficient dispersion is achieved, spinning is stopped and the mixture is allowed to cool down to approximately 60° F. from the approximately 90° F. temperature the mixture achieves due to the friction generated through mixing.

A suitable carrying catalyst, for example 5.0–10% by weight of an acid (e.g., phenolsulfonic acid), can then be added to the mixture, being careful to avoid introduction of air into the mixture. The mixture is again stirred vigorously, under vacuum, for approximately 5 minutes to disperse the catalyst. Mixing is then terminated, and the shaft and blades are carefully extracted to minimize the introduction of air into the mixture.

Although some degree of reaction may occur within the resin, this may be inhibited both by the presence of the diluent and by maintaining the mixture at a suitably low temperature to impede reaction.

It should be noted that the preferred embodiment of the invention has been described in accordance with the Tesla turbine mixer shown in FIGS. 2 and 3. However, any type of mixing device that can create the proper dispersion of the mixture can be used.

Figure 4:
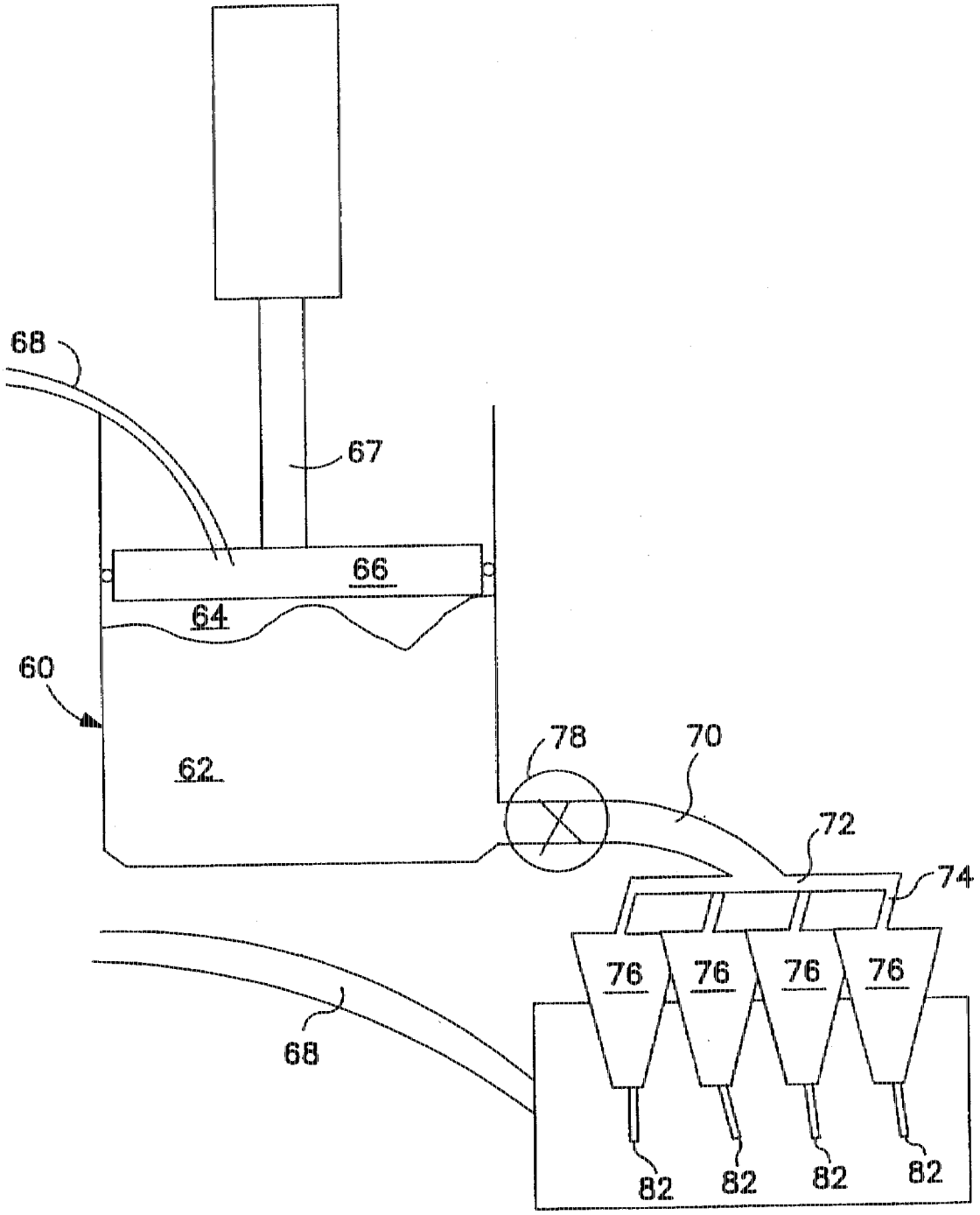
FIG. 4 is a schematic diagram of a mixing chamber, showing a piston urging the resin material from a chamber and through a manifold into a plurality of near net molds.

Referring now to FIG. 4, the mixing vessel 60, including the partially cured or uncured mixture 62, is then transferred to or otherwise engaged by a suitable piston 66 or other mechanism for purging the mixture from the vessel into suitable molds.

Piston 66, under the operation of a suitable ram 67 or other urging mechanism, is carefully urged toward the top of fluid 62, while the air and/or other gases within the region 64 between piston 66 and mixture 62 is drawn out of vessel 60, for example by a suitable vacuum line 68 which communicates with region 64. Piston 66 then urges the mixture through an appropriate valve 78 into conduit 70 and into a manifold 72 which communicates with conduit 70. From manifold 72, the mixture is urged into a plurality of lead lines 74 and thereafter into a plurality of corresponding molds 76.

While resident in molds 76, excess resinous liquid and/or diluent may be conveniently extracted from the molds, for example through extraction conduits 82, such as a frit plate or the like. In a particularly preferred embodiment, a buchner funnel or vacuum is drawn in each of extraction tubes 82 to controllably draw fluid from the mold cells.

With continued reference to FIG. 4, present inventors have determined that all of the resinous liquid may be left within mold 76 and ultimately cured. Alternatively, a large amount of uncured resinous liquid may be withdrawn from the mold; indeed, any desired amount of resinous liquid may be either left in the mold and allowed to cure or withdrawn from the mold prior to curing. Applicants have further determined that the amount of resinous liquid left in the mold or withdrawn from the mold largely determines the hardness of the finished stone. This selective resin withdrawing process from the partially cured, gelatinous composite within the mold is referred to herein as "tuning" the hardness of the finished stone. As briefly alluded to above, it is also possible to adjust (tune) the hardness of the finished stone by varying the amount of furfuryl alcohol added to the diluent earlier in the process, and by varying the ratio of resin to diluent. As a general rule, altering the amount of furfuryl alcohol added to the diluent, will modify the hardness of the finished stone. As a further rule of thumb, the more resinous liquid which is left in the mold during the final extraction process, the harder the finished the stone; conversely, the more resin or resinous liquid withdrawn from the mold during the curing phase, the lower the hardness of the finished stone.

After extracting a desired amount of resinous liquid from the molds, the mold may be placed in a warm (e.g., in the range of 75°–110° F. and preferably about 90° F. chamber or oven to allow the composite to cure to a firm gel. In a preferred embodiment, this may take in the range of 5–50 hours, and preferably around 20–30 hours, and most preferably approximately 24 hours. Once the composite has reached the firm gel stage after approximately 24 hours, an additional vacuum extraction of resinous liquid may be performed, for example by drawing a vacuum through extraction tube 82 in the range of 15–30, and preferably around 26 inches of mercury, for up to approximately 5 minutes. In this regard, the intensity of the vacuum and the length of time the gel is subject to vacuum should be carefully controlled to avoid cracking of the composite within the mold. Further extraction of resinous fluid at the gel stage allows further tuning of the hardness of the finished product.

As also briefly alluded to above, the porocity of the finished stone may also be tuned by adding more or less microballoons at the mixing stage. To facilitate the addition of more microballoons to thereby achieve a higher density cell structure, it may be desirable to add additional diluent at the mixing stage.

Once the final fluid extraction is performed, the stones may be removed from the molds and placed in a chamber or oven which is slowly ramped up to a temperature in the range of 20°–50° C., and most preferably around 40° C. In accordance with one aspect of the present invention, it is desirable to slowly ramp the temperature up to avoid boiling of the alcohol or other liquids within the composite to thereby avoid cracking of the composite. The stones are then maintained at approximately 40° C. for on the order of 6–30 hours, and most preferably about 24 hours. As a final curing operation, the temperature is then ramped up from 40° C. to approximately 120° C. over a period of approximately 10–35 hours, and most preferably over a period of approximately 12 hours. The stones are maintained at a temperature of 120° C. for approximately 0.1–10 hours, and most preferably for approximately 1 hour. This is believed to fully cure the stones and achieve maximum hardness. It is also believed that these latter heating stages fully desiccate (dry) any unincorporated formaldehyde which is liberated during the cross-linking process. In this regard, the final curing operation may also be carefully implemented to fine tune the hardness of the finished stone. For example, total curing of all residual resin within the mold will result in maximum hardness of the finished composite; conversely, by curing slightly less than all the available resin, a correspondingly lower hardness level will be achieved. Control of the latter stages of hardening may be effected by manipulating the final temperature above or below the 120° C. threshold, and also by varying the resident time at which the stones reside in the final curing stage for more or less than the aforementioned 1 hour threshold.

Finally, after the stones have been cured, they are mounted and glued to pie-shaped platen segments which are preferably aluminum. A belt sander is then used to sand the stones down to the exact shape of the segments. The platen segments with the grinding stones are then bolted to the grinding machine platen.

In accordance with a further aspect of the present invention, it may be advantageous to place a fabric or paper covering over the top of the composite if molds 76 are configured such that a portion of the stony composite is exposed to ambient air. The use of such a film or fabric will impede the formation of a skin, which could cause the formation of hardness gradients within the mold.

In accordance with yet a further aspect of the present invention, the stones can be cast directly onto disposable backing plates such as phenolic boards.

In accordance with yet a further aspect of the present invention, it may be advantageous to use a sound probe to measure the fluid density in the stone. Because the sound will travel through fluids faster than through air bodies, the sound probe will help determine whether the proper amount of liquid has been with out of the stone molds, thus allowing the production of more uniform batch hardnesses.

In accordance with yet a further embodiment of the present invention, the microballoons and a catalyst can be added to ceramics and other materials to control the porocity or pore density of the material.

It will be understood that the foregoing description is of preferred exemplary embodiments of the invention, and that the invention is not limited to the specific forms shown or described herein. Various modifications may be made in the design, arrangement, and quantity of the elements and chemical compositions disclosed herein, as well as the steps of making and using the invention without departing from the scope of the invention as expressed in the appended claims.

We claim:

1. A method for producing a workpiece grinding composition, the steps comprising:

preparing a silicon carbide mixture comprising a diluent, silicon carbide and a dispersing agent;

creating a dispersed silicon carbide compound by ball milling said silicon carbide mixture until agglomerates are removed from said silicon carbide mixture;

creating an abrasive cellular mixture by mixing said dispersed silicon carbide compound with a resinous compound and thermoplastic balloons in a pressurized mixing chamber, said microballoons causing said abrasive cellular mixture to have a cellular structure;

adding a catalyst to said abrasive cellular mixture and mixing said catalyst and said abrasive cellular mixture to ensure proper dispersion of said catalyst within said abrasive cellular mixture;

molding said abrasive cellular mixture into a shape; and placing said abrasive cellular mixture in a warming chamber to activate said catalyst and thereby cure said mixture into a solid grinding composition.

2. A workpiece grinding composition, comprising:

a dispersed silicon carbide compound formed by mixing a diluent, silicon carbide and a dispersing agent, wherein said compound is created by ball milling the mixture to remove agglomerates;

a resinous compound; and thermoplastic microballoons;

wherein said grinding composition is formed by mixing said dispersed silicon carbide compound, said resinous compound, said microballoons and a catalyst in a pressurized mixing chamber and then molding and curing said grinding composition so that said grinding composition has shape, density and hardness.

3. The method of claim 1, wherein said diluent comprises a mixture of water and ethanol.

4. The method of claim 3, wherein said diluent comprises about 40–50 percent by weight water and about 50–60 percent by weight ethanol.

5. The method of claim 1, wherein said diluent comprises a mixture of water, ethanol, and furfuryl.

6. The method of claim 5, wherein said diluent comprises about 30–60 percent by weight water, about 15–45 percent by weight ethanol and about 15–45 percent by weight furfuryl.

7. The method of claim 1, wherein said resinous compound is selected from the group consisting of a phenolic resin monomer, polymethylmethacrylates and epoxies.

8. The method of claim 7, wherein said resinous compound comprises about 20–35 percent by weight said phenolic resin monomer.

9. The method of claim 1, wherein said pressurized mixing chamber is maintained at a pressure of about 20–30 inches of mercury.

10. The method of claim 1, wherein said step of creating an abrasive cellular mixture by mixing said dispersed silicon carbide, said resinous compound and said microballoons is performed at a temperature of about 40°–60° F.

11. The method of claim 1, further comprising the step of measuring a fluid density of said grinding composition using a sound probe.

12. The method of claim 1, wherein said pressurized mixing chamber comprises a Tesla-style mixer which mixes said dispersed silicon carbide compound, said resinous compound, and said thermoplastic microballoons at a high rotation rate.

13. The method of claim 1, wherein said molding step further comprises the steps of:

pressing said abrasive cellular mixture into a mold from said mixing chamber using a pressing means; and while said abrasive cellular mixture is being pressed into said mold, purging gasses from said mixing chamber.

14. The method of claim 13, further comprising the step of extracting a resinous liquid from said mold to thereby tune the hardness of said grinding composition.

15. The method of claim 14, wherein the hardness of said grinding stone is determined by the quantity of said resinous liquid extracted from said mold.

16. The method of claim 14, wherein a vacuum is used to extract said excess liquid from said mold.

17. The method of claim 1, wherein the hardness of said grinding composition is controlled by manipulating the final curing time.

18. The method of claim 1, wherein the hardness of said grinding composition is controlled by manipulating the final curing temperature.

19. The method of claim 1, further comprising the steps of:

mounting said grinding composition to a platen; and sanding said grinding composition to an exact shape.

20. The method of claim 13, further comprising the step of covering said mold to prevent the formation of a skin on said abrasive pad.

21. The method of claim 1, wherein said step of preparing a silicon carbide mixture comprises mixing about 45–50 percent by weight diluent, about 45–60 percent by weight silicon carbide, and about 0.1–1 percent by weight dispersing agent.

22. The method of claim 1, wherein said step of creating an abrasive cellular mixture comprises mixing about 55–75 percent by weight dispersed silicon carbide, about 20–35 percent by weight resinous compound, and about 1–5 percent by weight microballoons.

23. The method of claim 1, wherein the size of said microballoons is about 20–200 microns.

24. The method of claim 1, wherein the poracity of said grinding stone may be tuned by adding more or fewer microballoons.

25. A method for producing an abrasive pad used in processing workpiece surfaces, the steps comprising:

preparing a diluent comprising ethanol and water;

forming a dispersed silicon carbide compound by ball mixing silicon carbide, said diluent and a dispersing agent until agglomerates are removed;

creating an abrasive cellular mixture by mixing said dispersed silicon carbide compound with a phenolic resin monomer and thermoplastic microballoons in a pressurized mixing chamber;

transferring said abrasive cellular mixture into a mold; and baking said abrasive cellular mixture at about 75°–100° F. for about 5–50 hours.

26. The method of claim 25, further comprising the step of adding a catalyst to said abrasive cellular mixture.

27. The grinding composition as recited in claim 2, wherein said diluent comprises a mixture of water and ethanol.

28. The grinding composition as recited in claim 27, wherein said diluent comprises about 40–50 percent by weight water and about 50–60 percent by weight ethanol.

29. The grinding composition as recited in claim 2, wherein said diluent comprises a mixture of water, ethanol, and furfuryl.

30. The grinding composition as recited in claim 29, wherein said diluent comprises about 30--60 percent by weight water, about 15--45 percent by weight ethanol and about 15--45 percent by weight furfuryl.

31. The grinding composition as recited in claim 2, wherein said resinous compound is selected from the group consisting of a phenolic resin monomer, polymethylmethacrylates and epoxies.

32. The grinding composition as recited in claim 31, wherein said resinous compound comprises about 20--35 percent by weight said phenolic resin monomer.

33. The grinding composition as recited in claim 2, wherein said dispersed silicon carbide compound comprises about 45--50 percent by weight diluent, about 45--60 percent by weight silicon carbide, and about 0.1--1 percent by weight dispersing agent.

34. The grinding composition as recited in claim 2, wherein said grinding composition comprises about 55--75 percent by weight dispersed silicon carbide, about 20--35 percent by weight resinous compound, and about 1--5 percent by weight microballoons.

35. The grinding composition as recited in claim 2, wherein the size of said microballoons is about 20--200 microns.

36. The grinding composition as recited in claim 2, wherein the porosity of said grinding stone may be tuned by adding more or fewer microballoons.

* * * * *